US009099831B2

(12) United States Patent
Lee

(10) Patent No.: US 9,099,831 B2
(45) Date of Patent: Aug. 4, 2015

(54) ELECTRICAL POWER CONNECTOR PREPARATION METHOD

(71) Applicant: RIIDEA International Corp., Apia (WS)

(72) Inventor: Lung-Hsi Lee, New Taipei (TW)

(73) Assignee: RIIDEA INTERNATIONAL CORP., Apia (WS)

( * ) Notice: Subject to any disclaimer, the term of this patent is extended or adjusted under 35 U.S.C. 154(b) by 202 days.

(21) Appl. No.: 13/776,345

(22) Filed: Feb. 25, 2013

(65) Prior Publication Data

US 2013/0227839 A1 Sep. 5, 2013

(30) Foreign Application Priority Data

Mar. 3, 2012 (TW) ..... 101107196 A

(51) Int. Cl.

| | |
|---|---|
| ***H01R 43/24*** | (2006.01) |
| ***H01R 43/16*** | (2006.01) |
| *H01R 103/00* | (2006.01) |
| *H01R 24/28* | (2011.01) |

(52) U.S. Cl.

CPC ..... *H01R 43/24* (2013.01); *H01R 43/16* (2013.01); *H01R 24/28* (2013.01); *H01R 2103/00* (2013.01); *Y10T 29/49176* (2015.01); *Y10T 29/49217* (2015.01)

(58) Field of Classification Search

CPC ..... H01R 43/16; H01R 43/24; H01R 43/28; H01R 24/28; H01R 2103/00; Y10T 29/49176; Y10T 19/49217

USPC ..... 29/874, 882, 884

See application file for complete search history.

(56) References Cited

FOREIGN PATENT DOCUMENTS

CN 102290661 A * 12/2011

* cited by examiner

*Primary Examiner* — Carl Arbes

(74) *Attorney, Agent, or Firm* — Muncy, Geissler, Olds & Lowe, P.C.

(57) ABSTRACT

An electrical power connector preparation method for making electrical power connectors by: employing a cold drawing technique with a series of dies to repeatedly draw a metal round rod into a thin thickness conducting contact bar, processing one end of the thin thickness conducting contact bar into a mating contact portion, stamping a part of the thin thickness conducting contact to form a mounting portion, repeating the aforesaid steps to obtain a large amount of metal contacts, using one or multiple contact material strips to hold multiple metal contacts in multiple sets, electroplating the metal contacts, using an insert molding technique to mold an electrically insulative terminal block on each set of metal contacts, and then assembling each set of metal contacts and the associating electrically insulative terminal block with one respective electrically insulative housing so that multiple electrical power connectors are obtained after removal of the contact material strips.

16 Claims, 14 Drawing Sheets

ELECTRICAL POWER CONNECTOR PREPARATION METHOD

BACKGROUND OF THE INVENTION

1. Field of the Invention

The present invention relates to electrical connector technology and more particularly, to an electrical power connector preparation method, which employs a cold drawing procedure to draw a metal round rod into a conducting contact bar, stamping and cutting techniques to process conducting contact bar into metal contacts, and insert molding technique to mold electrically insulative terminal blocks on metal contacts so that a large number of electrical power connectors can be formed rapidly at a time, saving the cost.

2. Description of the Related Art

Power sockets are widely used in electric and electronic devices, such as portable audio, audio and video players (CD, VCD, DVD players), computer, notebook computer, mobile phone and other information products for connection to a city power outlet for power input so that the electric and electronic devices can obtain the necessary working power supply and can be operated by a user.

A power socket has at least one metal contact that can be made in a solid or hollow form. A hollow metal contact, as shown in FIG. 13, is made by: using a stamping technique to stamp a metal sheet material, for example, copper sheet material, into a predetermined shape, and then bending the shaped copper sheet material into a cylindrical configuration having a rounded contact portion A at its one end and a flat mounting portion B at its other end. Because this design of hollow metal contact is made by curving a shaped copper sheet material into a cylindrical configuration without riveting, the applied force must be properly controlled when curving the shaped copper sheet material. If the applied force is excessively strong or insufficient, the two opposite side edges of the shaped copper sheet material may be not positively and accurately abutted against each other after formation of the metal contact, lowering the product yield rate. Further, a hollow metal contact has a relatively lower structural strength, and can easily be deformed or damaged upon connection between the power socket and a mating electrical connector. Further, when curving a shaped copper sheet material into a cylindrical configuration, a seam line will be left at the front side of the hollow metal contact, affecting the sense of beauty of the outer appearance of the hollow metal contact.

Further, a power socket using solid contacts is known, as shown in FIG. 14, comprising an electrically insulative housing C, and a first solid contact D and a second solid contact E mounted in the electrically insulative housing C. The first solid contact D has a locating flange D1 extending around the periphery thereof and positioned in a front side of a back wall of the electrically insulative housing C and a rear mounting end D2 extended out of the back wall of the electrically insulative housing C. The second solid contact E is riveted to the rear mounting end D2 of the first solid contact D. Further, the first solid contact D is made of a metal material using a milling technique. However, because the locating flange D1 has a relatively larger outer diameter than the first solid contact D, the metal material used for making the first solid contact pin D must have a diameter not less than the outer diameter of the locating flange D1. Thus, about 40% of the metal material is wasted, increasing the material cost. Further, further waste recycling is necessary to recycle waste metal material. Further, because the first solid contact D and the second solid contact E are riveted together, they may be loosened from each other after a long use. If the first solid contact D and the second solid contact E are loosened, a large electrical resistance may be produced during transmission of electricity, leading to the problems of high temperature, contact error, electric shock or connector dropping and severely affecting application safety.

Thus, the fabrication of electrical power connectors using either solid or hollow metal contacts according to the prior art methods has the drawbacks of low metal contact structural strength, low product yield rate, large amount of waste material, requirement of an extra waste material recycling treatment, and high manufacturing cost.

Therefore, it is desirable to provide a method for making metal contacts and electrical power connectors that eliminates the aforesaid problems.

SUMMARY OF THE INVENTION

The present invention has been accomplished under the circumstances in view. It is therefore the main object of the present invention to provide an electrical power connector preparation method, which greatly improves electrical power connector fabrication efficiency, shortens electrical power connector fabrication time, increases electrical power connector yield rate, and reduces electrical power connector manufacturing cost.

To achieve this and other objects of the present invention an electrical power connector preparation method comprises the steps of: employing a cold drawing technique with the use of a series of dies having different diameters of drawing holes to repeatedly draw a metal round rod into a thin thickness conducting contact bar, processing one end of the thin thickness conducting contact bar into a mating contact portion, stamping a part of the thin thickness conducting contact to form a mounting portion, cutting off the thin thickness conducting contact bar to obtain a finished metal contact, repeating the aforesaid steps to obtain a large amount of metal contacts, and then using one or multiple contact material strips to hold multiple metal contacts in multiple sets, electroplating the metal contacts, and then using an insert molding technique to mold an electrically insulative terminal block on each set of metal contacts, and then assembling the multiple sets of metal contacts and the associating electrically insulative terminal blocks with respective electrically insulative housings to form multiple electrical power connectors. Subject to this preparation method, a large number of high structural strength metal contacts can be rapidly made and a large number of electrical power connectors can be rapidly assembled, shortening electrical power connector manufacturing time, improving the electrical power connector manufacturing efficiency, and saving the electrical power connector manufacturing cost.

Further, a shoulder is formed on each metal contact between the mating contact portion and the mounting portion during the performance of the stamping technique. After molding of one electrically insulative terminal block on one respective set of metal contacts, the shoulders of metal contacts are embedded in the respective electrically insulative terminal block, and thus, the metal contacts and the respective electrically insulative terminal block are tightly secured together. The metal contacts and the associating electrically insulative terminal block can then be assembled with an respective electrically insulative housing to force respective retaining protrusions and locating grooves of the electrically insulative terminal block into engagement with respective retaining grooves and locating blocks of the respective electrically insulative housing, thereby forming an electrical power connector having the characteristics of high stability, high reliability and long lifespan.

DETAILED DESCRIPTION OF THE PREFERRED EMBODIMENT

Figure 1:
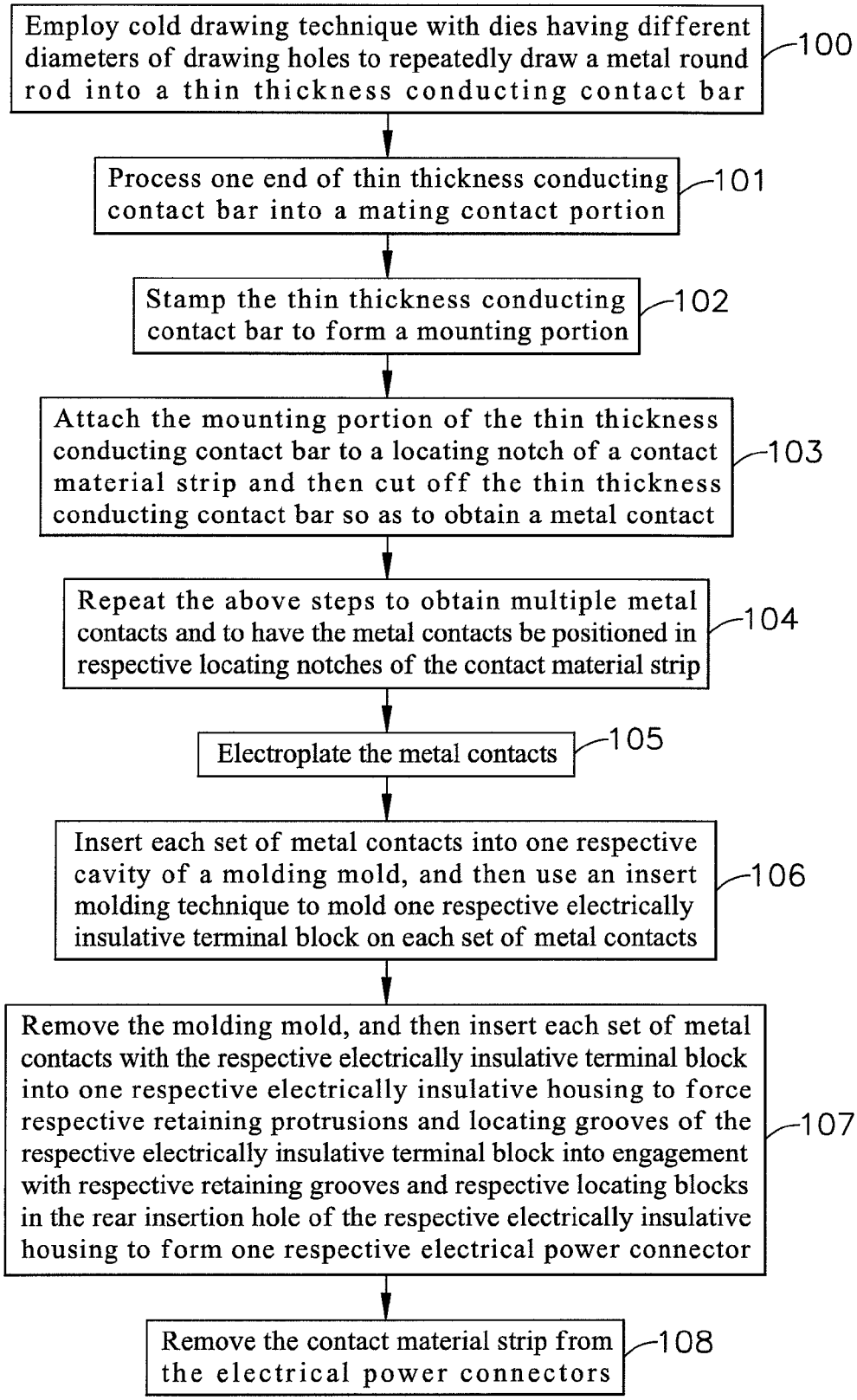
FIG. 1 is a flow chart of an electrical power connector preparation method in accordance with a first embodiment of the present invention.
Figure 2:
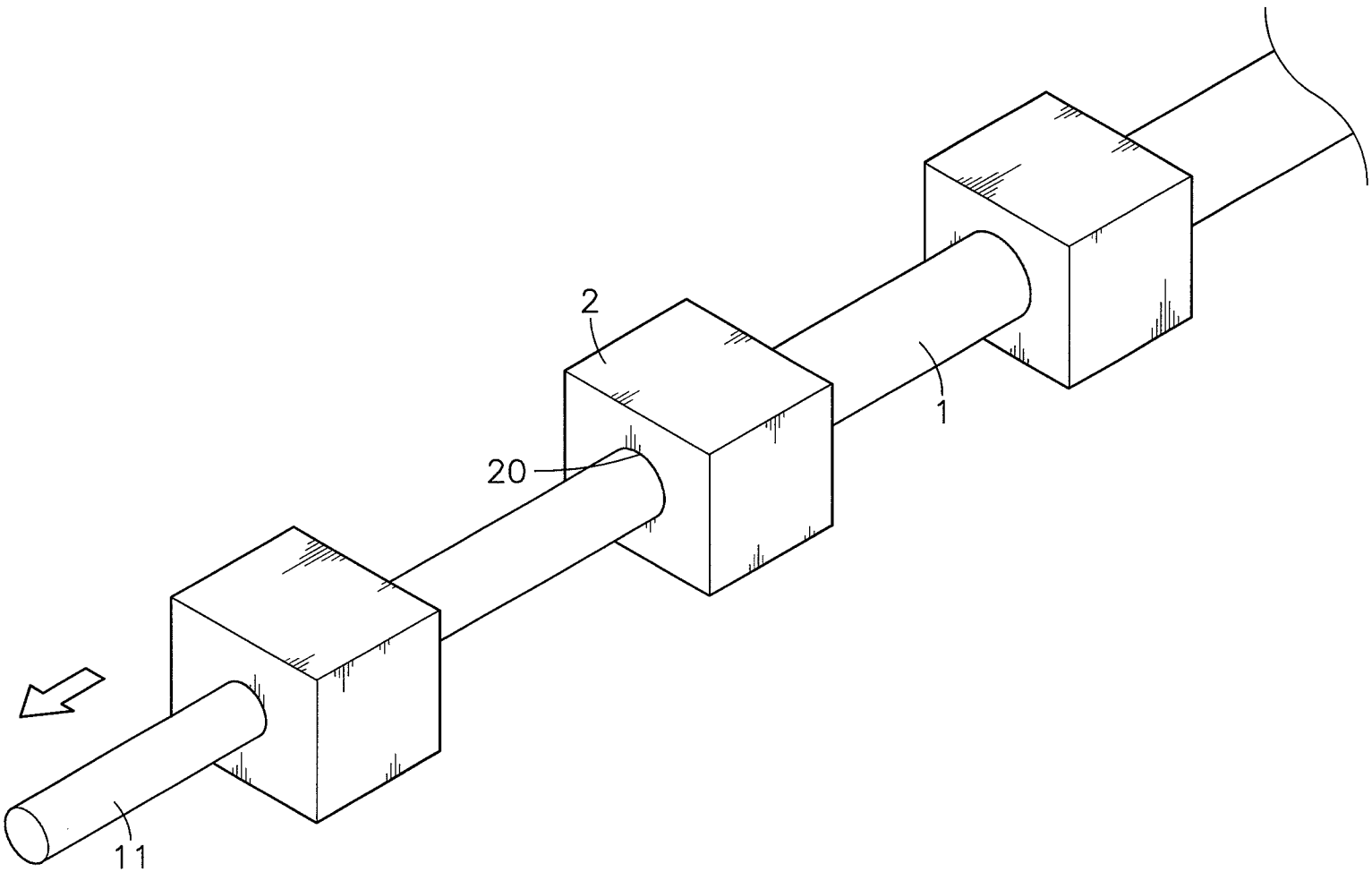
FIG. 2 is a schematic drawing illustrating the performance of a cold drawing step of the electrical power connector preparation method in accordance with the first embodiment of the present invention.
Figure 3:
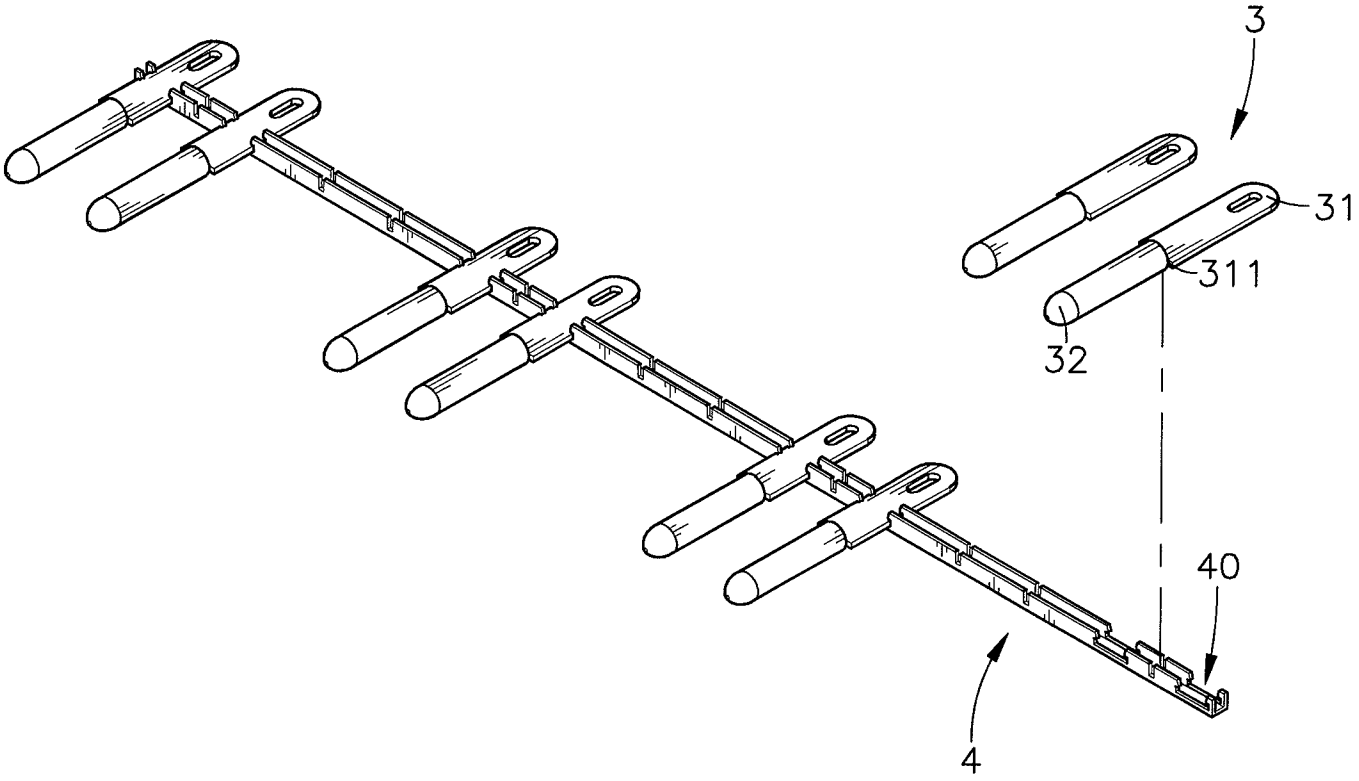
FIG. 3 is a schematic drawing illustrating installation of metal contacts in a contact material strip during the application of the electrical power connector preparation method in accordance with the first embodiment of the present invention.
Figure 4:
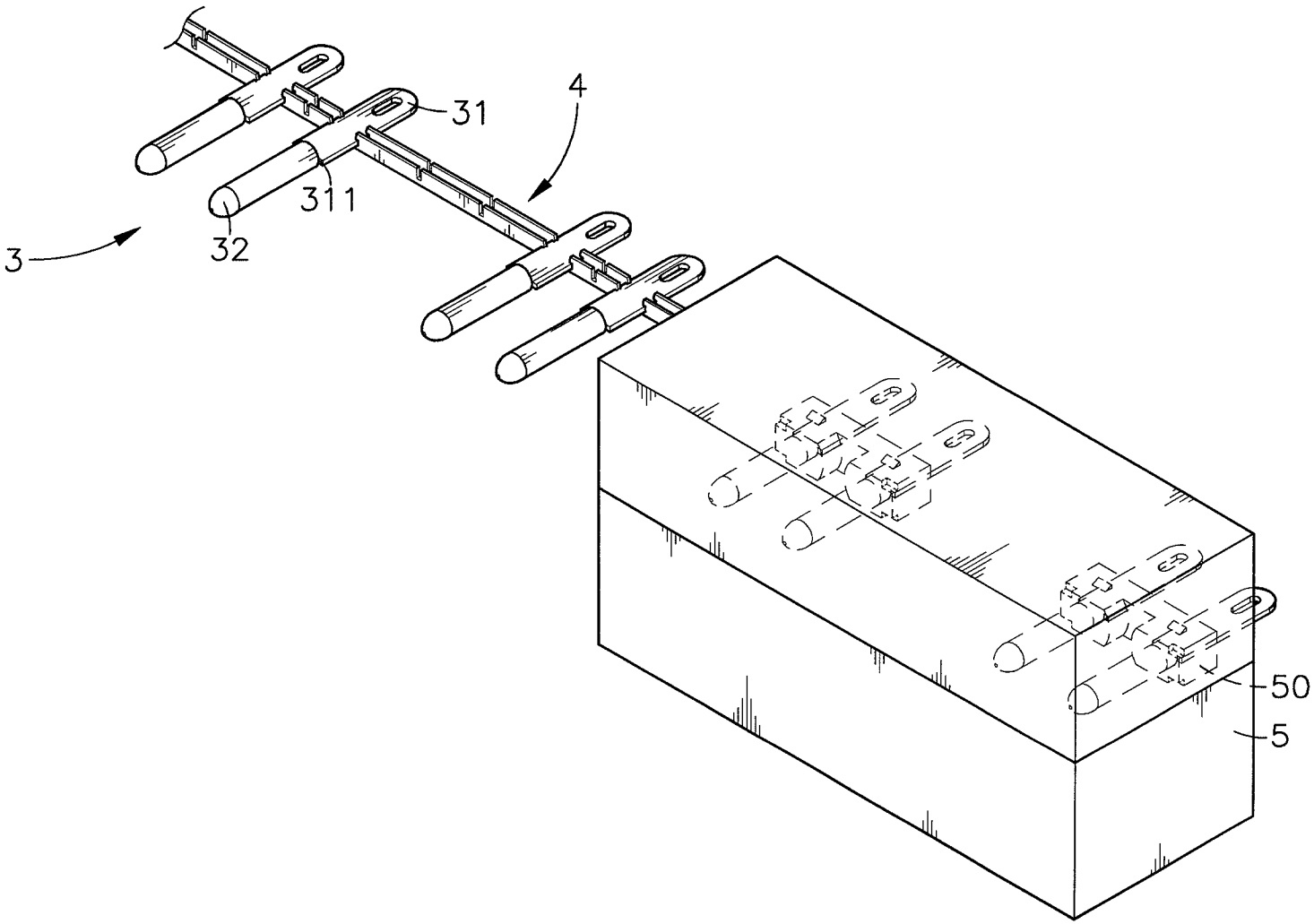
FIG. 4 is a schematic drawing illustrating the contact material strip moved toward a mold and metal contacts inserted into respective cavities of the mold during the application of the electrical power connector preparation method in accordance with the first embodiment of the present invention.
Figure 5:
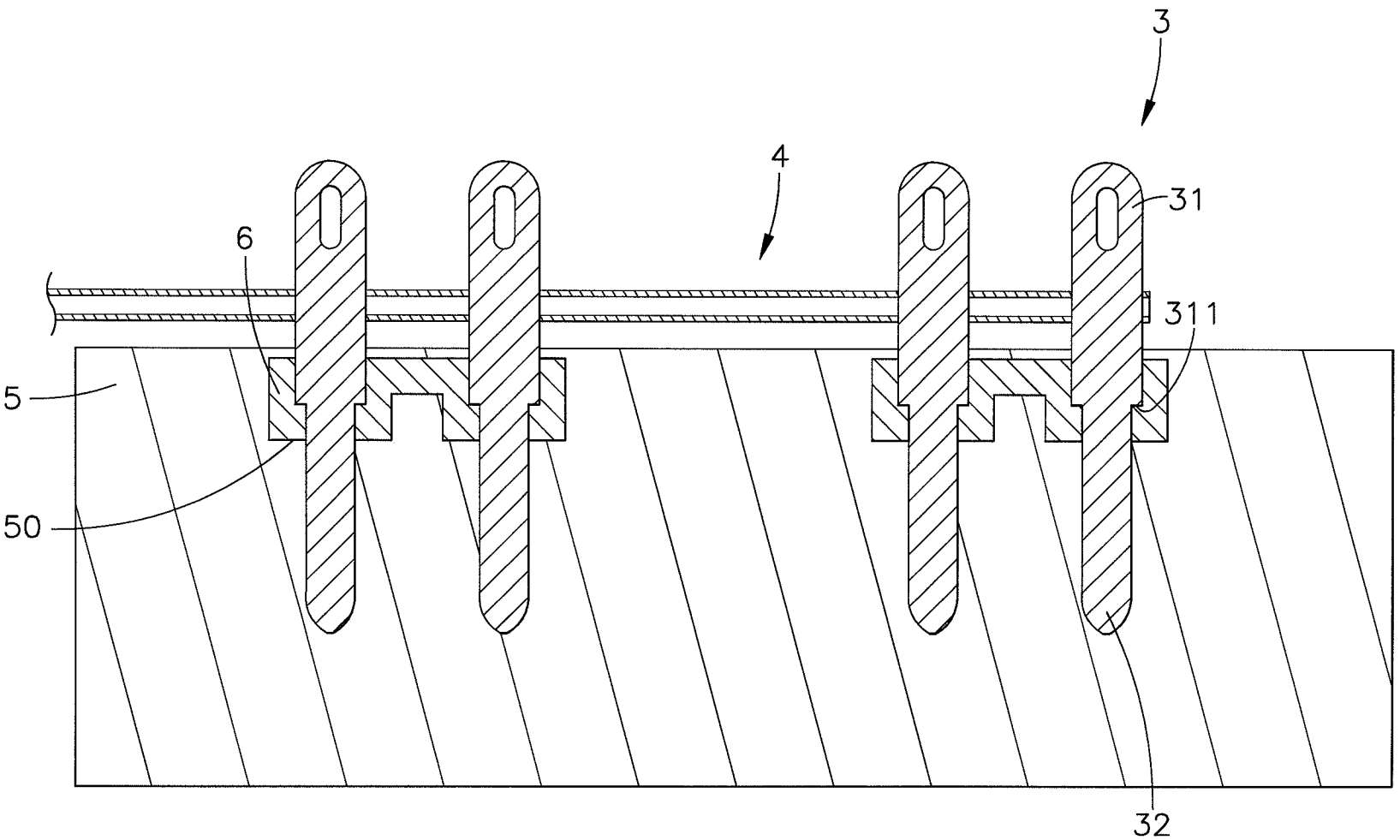
FIG. 5 is a sectional top view, in an enlarged scale, of a part of FIG. 4.
Figure 6:
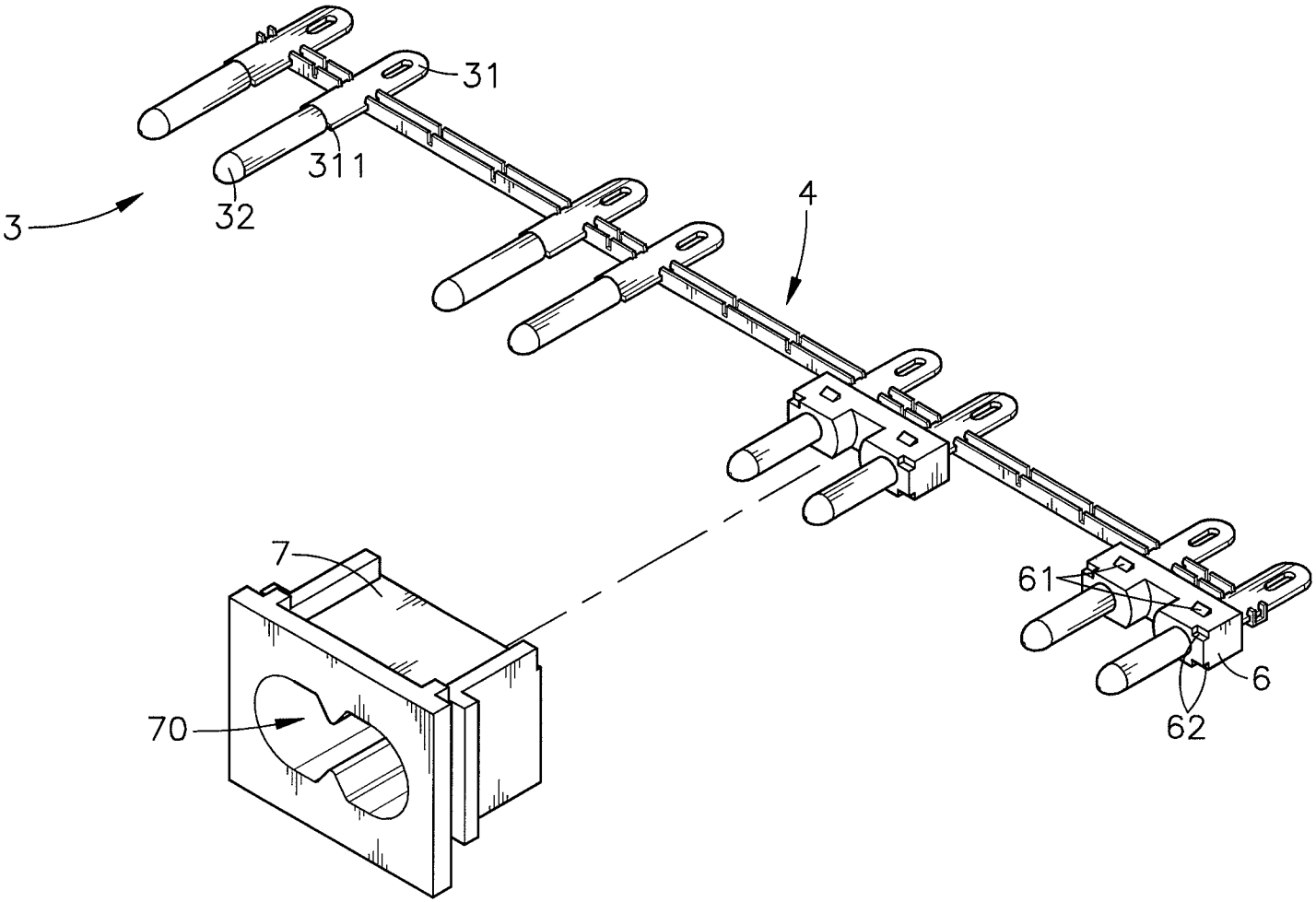
FIG. 6 is a schematic drawing illustrating an electrically insulative terminal block molded on one respective set of metal contacts at one contact material strip before installation in an electrically insulative housing in accordance with the first embodiment of the present invention.
Figure 7:
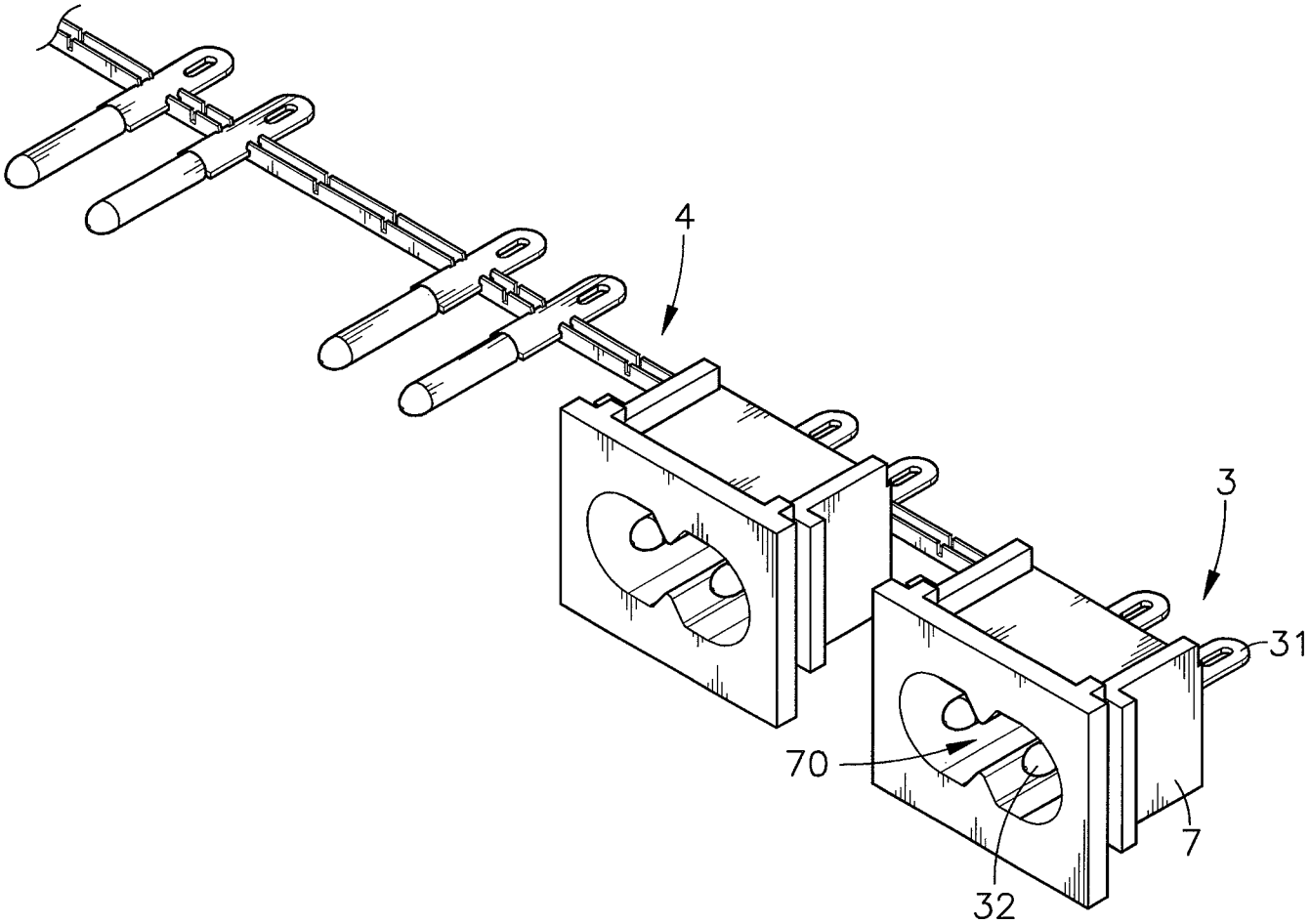
FIG. 7 corresponds to FIG. 6, illustrating each set of metal contacts with the associating electrically insulative terminal block inserted into one respective electrically insulative housing to form one respective electrical power connector.
Figure 8:
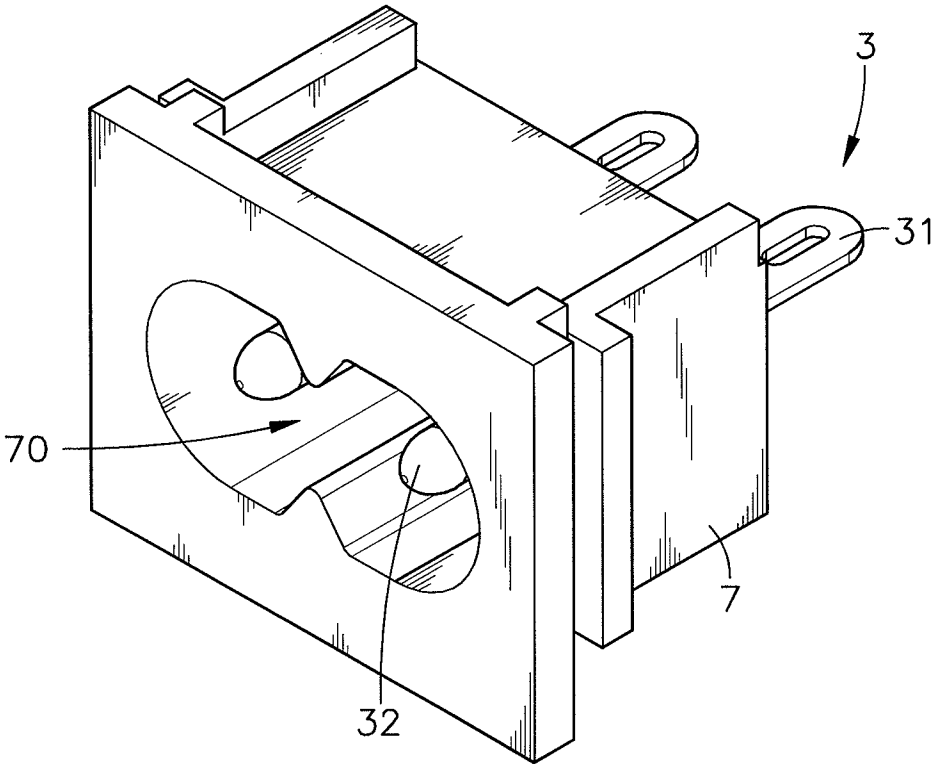
FIG. 8 is an elevational view of an electrical power connector made in accordance with the first embodiment of the present invention.
Figure 9:
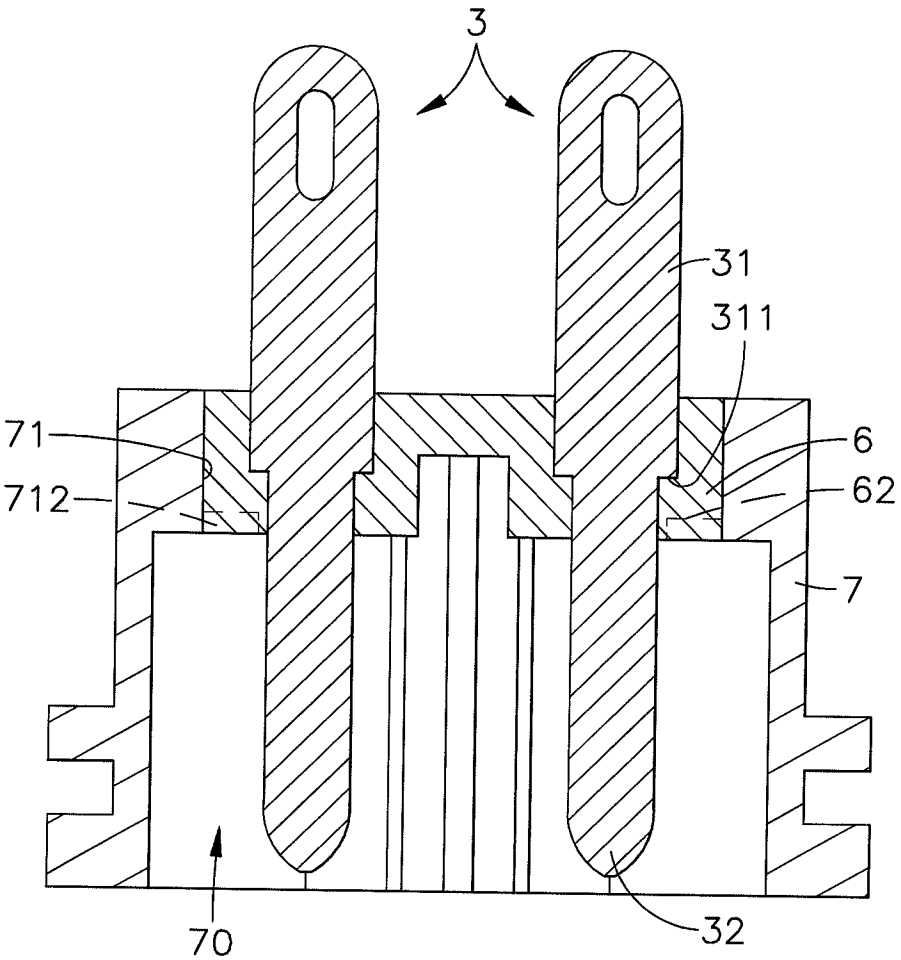
FIG. 9 is a sectional top view, in an enlarged scale, of the electrical power connector shown in FIG. 8.
Figure 10:
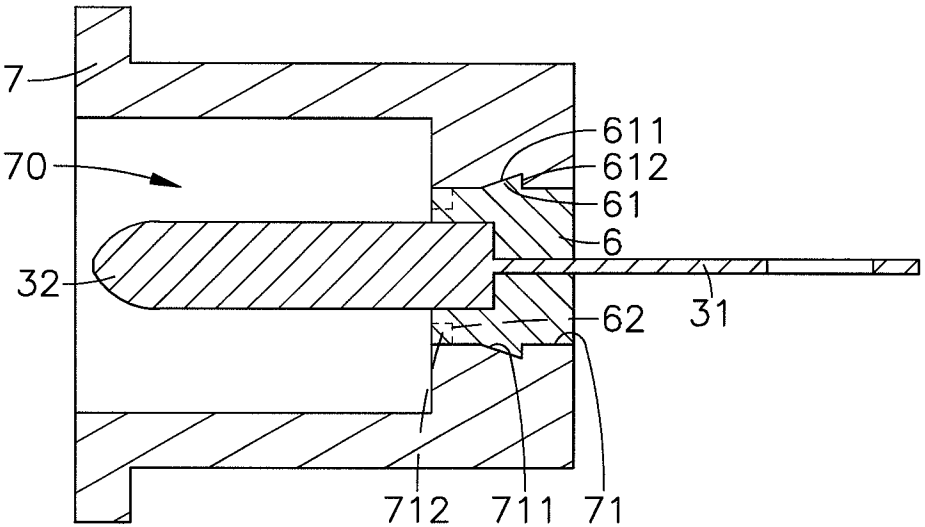
FIG. 10 is a sectional side view of the electrical power connector shown in FIG. 8.

Referring to FIGS. 1-10, an electrical power connector preparation method in accordance with a first embodiment of the present invention is shown, comprising the steps of:

(100) employing a cold drawing technique with a series of dies 2 having different diameters of drawing holes 20 to repeatedly draw a metal round rod 1, for example, copper or copper alloy round rod, into a thin thickness conducting contact bar 11;

(101) processing one end of the thin thickness conducting contact bar 11 into a mating contact portion 32;

(102) stamping a part of the thin thickness conducting contact bar 11 to form a mounting portion 31;

(103) attaching a part of the mounting portion 31 of the thin thickness conducting contact bar 11 to a locating notch 40 of a contact material strip 4, and then cutting off the thin thickness conducting contact bar 11 so that a finished metal contact 3 formed of the mounting portion 31 and the mating contact portion 32 is provided and left in one locating notch 40 of the contact material strip 4;

(104) repeating steps (100)~(103) to obtain a plurality of metal contacts 3 and to have these metal contacts 3 be positioned in respective locating notches 40 of the contact material strip 4 in such a manner that each two metal contacts 3 are arranged in a set in a parallel manner and the multiple sets of metal contacts 3 are spaced from one another along the length of the contact material strip 4 at a predetermined interval;

(105) electroplating the metal contacts 3 that are held in the contact material strip 4

(106) inserting the mating contact portions 32 of each set of metal contacts 3 at the contact material strip 4 and a part of the associating mounting portions 31 into one respective cavity 50 of a molding mold 5, and then using an insert molding technique to mold respective electrically insulative terminal block 6 on each set of metal contacts 3;

(107) removing the molding mold 5, and then inserting each set of metal contacts 3 with the respective electrically insulative terminal block 6 though a rear insertion hole 71 of one respective electrically insulative housing 7 into a front receiving chamber 70 of the respective electrically insulative housing 7 to force respective retaining protrusions 61 and locating grooves 62 of the respective electrically insulative terminal block 6 into engagement with respective retaining grooves 711 and respective locating blocks 712 in the rear insertion hole 71 of the respective electrically insulative housing 7; and (108) removing each assembly of one set of metal contacts 3 with the associating electrically insulative terminal block 6 and electrically insulative housing 7 from the contact material strip 4, and therefore, electrical power connectors are obtained.

Further, the mounting portion 31 of each metal contact 3 has a flat shape configured for wire bond, wire clamp or DIP (dual inline package) application. Further, the mating contact portion 32 can have a conical shape. Further, when stamping one end of the thin thickness conducting contact bar 11 into a mounting portion 31, a shoulder 311 is formed on the thin thickness conducting contact bar 11 between the mounting portion 31 and the associating mating contact portion 32.

Further, the contact material strip 4 has a U-shaped cross section with locating notches 40 located at the two parallel upright sidewalls of the U-shaped cross section. Further, after processed metal contacts 3 are held in the locating notches 40 of the contact material strip 4, the metal contacts 3 are electroplated partially or locally using a dip electroplating or brush electroplating technique. Further, the molding mold 5 used in the aforesaid electrical power connector preparation procedure can be designed to provide one or a number of cavities 50 so that one or a number of electrically insulative terminal blocks 6 can be molded on each respective set of metal contacts 3 by means of insert molding. Subject to the design of the shoulder 311 of each metal contact 3, the bonding tightness between each electrically insulative terminal block 6 and the associating set of metal contacts 3 is greatly enhanced, avoiding falling of the metal contacts 3 from the respective electrically insulative terminal block 6. Further, each retaining protrusion 61 of the electrically insulative terminal block 6 defines a front sloping guide surface 611 and a rear vertical stop surface 612. Further, the locating grooves 62 are respectively located in corners of the front wall of the electrically insulative terminal block 6.

Further, the electrically insulative housing 7 is an independent member separately made, comprising a front receiving chamber 70 defined in the front side thereof, a rear insertion hole 71 defined in the rear side thereof in communication with the front receiving chamber 70, a plurality of retaining grooves 711 located in the inside wall thereof in communication with the rear insertion hole 71, and a plurality of locating blocks 712 respectively disposed in the front side of the rear insertion hole 71 and facing toward the front receiving chamber 70. When inserting each set of metal contacts 3 with the respective electrically insulative terminal block 6 though the rear insertion hole 71 of one respective electrically insulative housing 7 into the front receiving chamber 70 of the respective electrically insulative housing 7, the front sloping guide surfaces 611 of the retaining protrusions 61 of the electrically insulative terminal block 6 will guide the respective retaining protrusions 61 into the respective retaining grooves 711 in the rear insertion hole 71. After the retaining protrusions 61 entered the respective retaining grooves 711, the rear vertical stop surfaces 612 of the retaining protrusions 61 are respectively stopped against respective back walls of the respective retaining grooves 711 to prohibit the electrically insulative terminal block 6 from backward displacement relative to the respective electrically insulative housing 7, and the locating grooves 62 of the electrically insulative terminal block 6 are respectively kept in engagement with the respective locating blocks 712 in the rear insertion hole 71 of the electrically insulative housing 7. At this time, the mating contact portions 32 of each set of metal contacts 3 are kept suspending in the front receiving chamber 70 of the electrically insulative housing 7.

Subject to the use of one contact material strip 4 to hold multiple sets of metal contacts 3 at a predetermined interval, multiple sets of metal contacts 3 can be simultaneously and accurately inserted into respective cavities 50 in one or multiple molding molds 5 either by manual operation or by means of an automatic or semi-automatic equipment, and thus, multiple electrically insulative terminal blocks 6 can be simultaneously molded on respective sets of metal contacts 3 by means of insert molding at a time, improving the electrical power connector manufacturing efficiency, shortening the electrical power connector manufacturing time and increasing the electrical power connector manufacturing yield rate. Further, as stated above, the design of the shoulder 311 of each metal contact 3 enables the bonding tightness between each electrically insulative terminal block 6 and the associating set of metal contacts 3 to be greatly enhanced. Further, subject to engagement between the retaining protrusions 61 and locating grooves 62 of the electrically insulative terminal block 6 and the retaining grooves 711 and locating blocks 712 of the electrically insulative housing 7, the metal contacts 3 are positively held in the front receiving chamber 70 of the electrically insulative housing 7 for positive contact with respective mating metal contacts of a male mating electrical power connector, prolonging the lifespan of the electrical power connector.

Further, by means of repeating steps (100)~(103), a large amount (50 pcs, 100 pcs, 150 pcs, 200 pcs or more) of metal contacts 3 can be prepared within a short period of time. After preparation of a large amount of metal contacts 3, steps (104)~(107) are performed, and thus a plurality of electrical power connectors can be rapidly made.

Further, after molding of one respective electrically insulative terminal block 6 on each set of metal contacts 3, the molding mold 5 is removed from each set of metal contacts 3 and the respective electrically insulative terminal blocks 6, and each set of metal contacts 3 with the respective electrically insulative terminal block 6 is moved towards one respective electrically insulative housing 7 by moving the contact material strip 4 carrying the metal contacts 3 and installed in one respective electrically insulative housing 7. Then, the contact material strip 4 is removed, and thus multiple electrical power connectors are rapidly assembled. In some applications, the contact material strip 4 is cut to a predetermined length so that a predetermined number of set of metal contacts 3 with the electrically insulative terminal blocks 6 are carried at the contact material strip 4. Subject to the aforesaid preparation method, one contact material strip 4 can hold multiple (5, 10 or 20) sets of metal contacts 3 for allowing multiple electrically insulative terminal blocks 6 to be respectively molded on the multiple sets of metal contacts 3 at a time and then assembled with respective electrically insulative housing 7. Alternatively, the metal contacts 3 with the respective electrically insulative terminal blocks 6 are removed from the contact material strip 4 and then installed in the respective electrically insulative housing 7.

Figure 11:
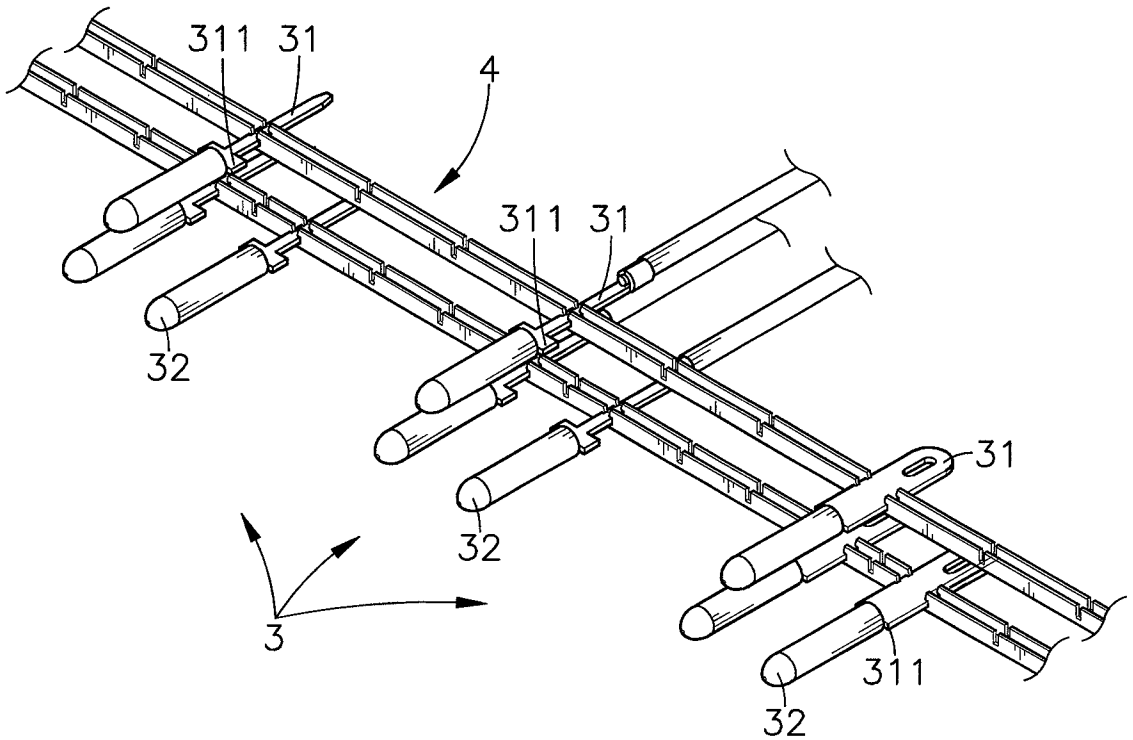
FIG. 11 a schematic drawing illustrating different forms of metal contacts made and positioned in vertically spaced contact material strips during application of an electrical power connector preparation method in accordance with a second embodiment of the present invention.

Referring to FIG. 11 and FIGS. 2 and 3 again, an electrical power connector preparation method in accordance with a second embodiment of the present invention is substantially similar to the aforesaid first embodiment with the exception of the following features. After processed one end of the prepared thin thickness conducting contact bar 11 into a mating contact portion 32, stamp a part of the thin thickness conducting contact bar 11 to form a substantially I-shaped or plug pin type flat mounting portion 31 that has its front end forming a shoulder 311 and connected to the mating contact portion 32 and its other end cut off from the thin thickness conducting contact bar 11 to provide a clamping tailpiece or plug tip. In the case that the distal end of the I-shaped flat mounting portion 31 of each metal contact 3 is processed to provide a clamping tailpiece, this clamping tailpiece can be rolled up and fastened to the conductor of an electrical wire. Thereafter, an electrically insulative terminal block is molded on each set of metal contacts 3 and then assembled with one respective electrically insulative housing to form one respective DIP (dual inline package) type electrical power connector.

Alternatively, after preparation of a large amount of metal contacts 3, attach metal contacts 3 to respective locating notches 40 of one first contact material strip 4 in such a manner that the metal contacts 3 are spaced from one another along the length of the first contact material strip 4 at a predetermined first interval and attach metal contacts 3 to respective locating notches 40 of a second contact material strips 4 in such a manner that each two metal contacts 3 are arranged in a set in a parallel manner and the multiple sets of metal contacts 3 at the second contact material strip 4 are spaced from one another along the length of the second contact material strip 4 at a predetermined second interval, and then hold the first and second contact material strips 4 with the respective metal contacts 3 at different elevations to suspend each metal contact 3 at the first contact material strip 4 above one respective set of metal contacts 3 at the second contact material strip. Then insert the mating contact portions 32 of each set of metal contacts 3 at the first contact material strip 4 and the mating contact portions 32 of the corresponding set of metal contacts 3 at the second contact material strip 4 into one respective cavity 50 of one respective molding mold 5. Then mold one respective electrically insulative terminal block 6 on each metal contact 3 at the first contact material strip 3 and one respective set of metal contacts 3 at the second contact material strip 4 for making a 3-pin electrical power connector.

Further, an electrical power connector made in accordance with the present invention can be installed in an electrical home appliance for the connection of a mating power cable for power input.

Figure 12:
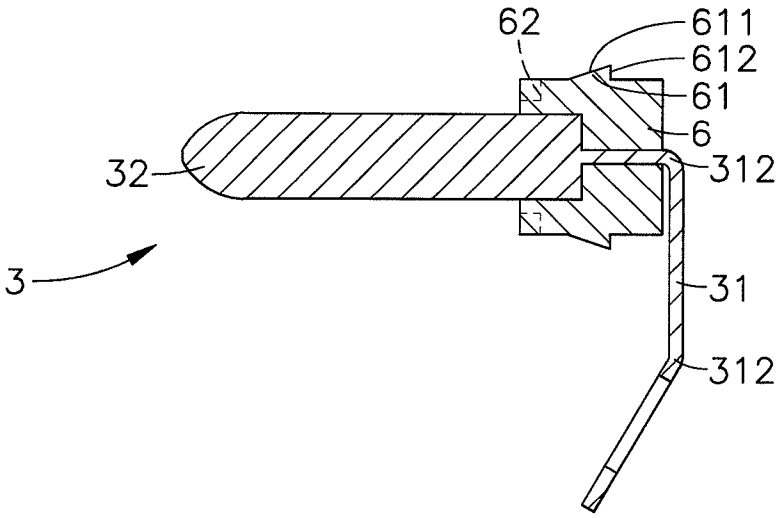
FIG. 12 is a schematic sectional view illustrating the mounting portion of the metal contact bent into two curved portions according to the present invention.
Figure 13:
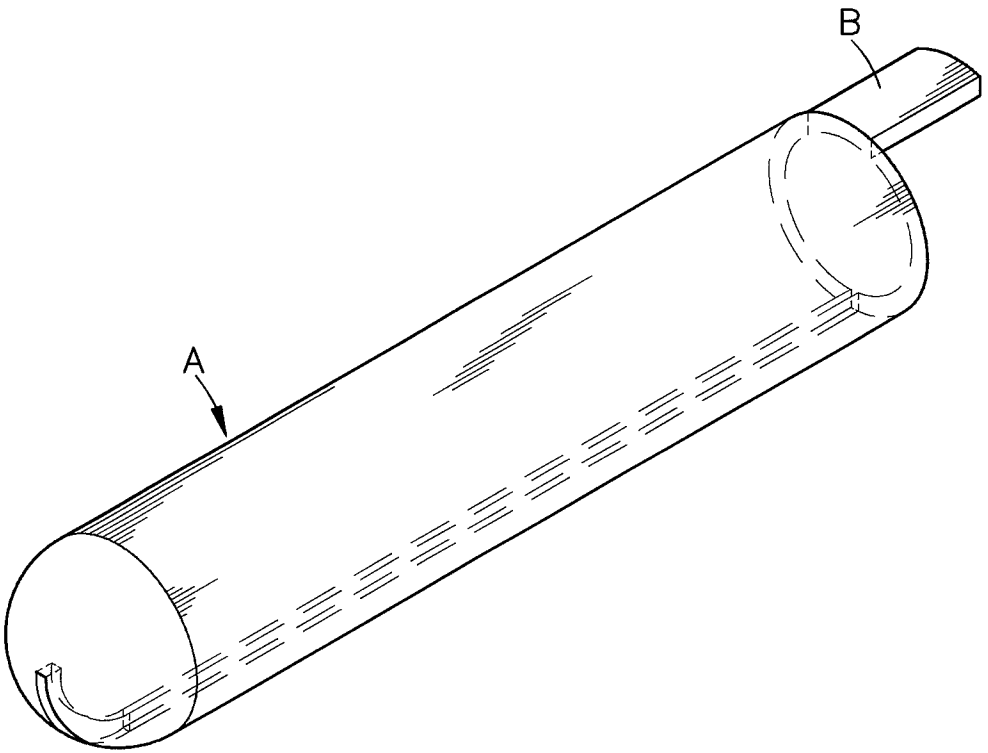
PRIOR ART FIG. 13
FIG. 13 is a schematic perspective view of a metal contact for electrical power connector according to the prior art.
Figure 14:
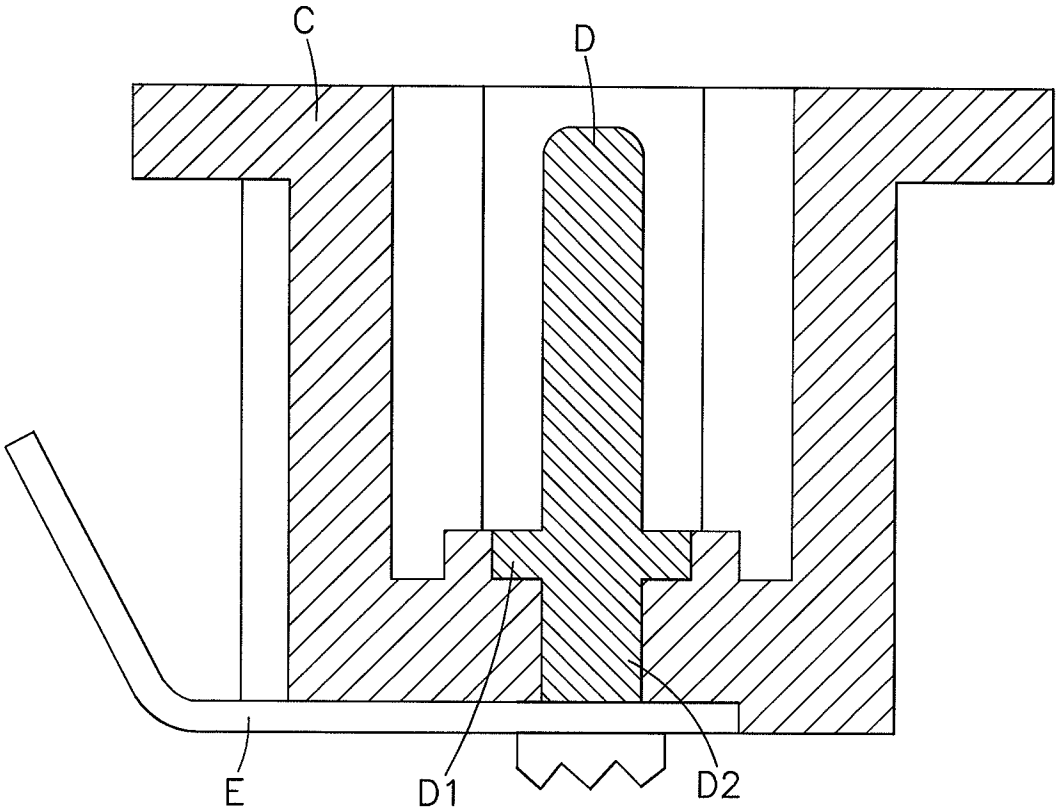
PRIOR ART FIG. 14
FIG. 14 is a sectional side view of an electrical power connector according to the prior art.

Referring to FIGS. 12 and FIGS. 1 and 10 again, after formation of the mounting portion 31 of each metal contact 3 in either of the aforesaid first and second embodiments, a sub step can be employed to bend the mounting portion 31 of each metal contact 3 into at least one curved portion 312, for example, a first curved portion disposed close to the electrically insulative terminal block 6 and defining a 90-degrees contained angle, and a second curved portion disposed remote from the electrically insulative terminal block 6 and defining a contained angle over 90 degrees. Further, this sub step can be employed after step (105) where the respective metal contacts 3 are electroplated, or after step (107) where the molding mold 5 is removed from the respective metal contacts 3.

As stated above, the invention provides an electrical power connector preparation method for making electrical power connectors by: employing a cold drawing technique with the use of a series of dies 2 having different diameters of drawing holes 20 to repeatedly draw a metal round rod 1 into a thin thickness conducting contact bar 11, processing one end of the thin thickness conducting contact bar 11 into a mating contact portion 32, stamping a part of the thin thickness conducting contact 11 to form a mounting portion 31, cutting off the thin thickness conducting contact bar 11 so that a finished metal contact 3 formed of the mounting portion 31 and the mating contact portion 32 is obtained, repeating the aforesaid steps to obtain a large amount of metal contacts 3, attaching individual metal contacts 3 to respective locating notches 40 of a contact material strip 4, using an insert molding technique to mold electrically insulative terminal blocks 6 on the metal contacts 3, assembling the metal contacts 3 and the associating electrical insulative terminal blocks 6 with respective electrical insulative housing 7 to form respective electrical power connectors at a time, and then removing the contact material strip 4 from the metal contacts 3 of the assembled electrical power connectors.

In conclusion, the invention provides an electrical power connector preparation method for making electrical power connectors, which has the advantages and features as follows:

1. The invention can obtain a large amount of metal contacts 3 rapidly and economically without producing much waste material by: employing a cold drawing technique with a series of dies 2 having different diameters of drawing holes 20 to repeatedly draw a metal round rod 1 into a thin thickness conducting contact bar 11, processing one end of the thin thickness conducting contact bar 11 into a mating contact portion 32 and stamping a part of the thin thickness conducting contact 11 to form a mounting portion 31, cutting off the thin thickness conducting contact bar 11, and then repeating the aforesaid steps.
2. When a metal contact 3 is prepared, a shoulder 311 is formed between the mounting portion 31 and the mating contact portion 3. After molding of an electrically insulative terminal block 6 on one set of metal contacts 3 using a molding mold 5, the shoulders 311 of the set of metal contacts 3 are embedded in the electrically insulative terminal block 6, and the metal contacts 3 and the associating electrically insulative terminal block 6 can then be assembled with an electrically insulative housing 7 to force the retaining protrusions 61 and locating grooves 62 of the electrically insulative terminal block 6 into engagement with the retaining grooves 711 and locating blocks 712 of the electrically insulative housing 7, thereby forming an electrical power connector having the characteristics of high stability, high reliability and long lifespan.
3. By means of using contact material strips 4 to hold a large amount of metal contacts 3, an automatic equipment or manual equipment can be used and operated to move contact material strips 4, moving carried metal contacts 3 into cavities 50 of one or a number of molding molds 5 for insert molding, facilitating mass production, and therefore, the invention greatly shortens electrical power connector manufacturing time and greatly improves electrical power connector manufacturing efficiency.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An electrical power connector preparation method, comprising the steps of:

(a) employing a cold drawing technique to draw a metal round rod into a thin thickness conducting contact bar;

(b) processing one end of said thin thickness conducting contact bar into a mating contact portion;

(c) stamping a part of said thin thickness conducting contact to form a mounting portion;

(d) attaching a part of said mounting portion of said thin thickness conducting contact to one of a plurality of locating notches of one contact material strip and then cutting off said thin thickness conducting contact subject to a predetermined length to obtain a finished metal contact;

(e) repeating steps (a)~(d) to obtain a plurality of said metal contacts and to have said metal contacts be positioned in respective locating notches of at least one said contact material strip in such a manner that a predetermined number of said metal contacts is arranged in a set and multiple sets of said metal contacts are spaced from one another along the length of said at least one contact material strip at a predetermined interval;

(f) electroplating said metal contacts that are held in said at least one said contact material strip;

(g) inserting the mating contact portions of each set of said metal contacts at said at least one contact material strip and a part of the mounting portions of the respective said metal contacts into one respective cavity of a molding mold, and then using an insert molding technique to mold one respective electrically insulative terminal block on each set of said metal contacts;

(h) removing said molding mold, and then inserting each set of said metal contacts with the respective said electrically insulative terminal block through a rear insertion hole of one respective electrically insulative housing into a front receiving chamber of the respective said electrically insulative housing to force respective retaining protrusions of the respective said electrically insulative terminal block into engagement with respective retaining grooves in said rear insertion hole of the respective said electrically insulative housing.

2. The electrical connector preparation method as claimed in claim 1, wherein said metal round rod is selected from the material group of copper and copper alloys.

3. The electrical connector preparation method as claimed in claim 1, wherein said mounting portion made during step (c) is configured for one of wire bond, wire clamp and DIP (dual inline package) applications.

4. The electrical connector preparation method as claimed in claim 1, wherein a shoulder is formed on said thin thickness conducting contact between said mating contact portion and said mounting portion when stamping a part of said thin thickness conducting contact to form said mounting portion during step (c).

5. The electrical connector preparation method as claimed in claim 1, wherein repeating steps (a)~(d) during step (e) is to obtain a plurality of said metal contacts subject to a predetermined amount, and steps (e)~(h) are performed after preparation of the desired amount of said metal contacts at step (e).

6. The electrical connector preparation method as claimed in claim 1, further comprising a sub step of electrically connecting one respective electrical wire to the mounting portion of each said metal contact after step (f) and before step (g).

7. The electrical connector preparation method as claimed in claim 1, wherein said contact material strip used during step (d) has a U-shaped cross section, and each said locating notch of said contact material strip is located at two parallel upright sidewalls of said U-shaped cross section.

8. The electrical connector preparation method as claimed in claim 1, wherein during step (g) to insert the mating contact portions of each set of said metal contacts at said at least one contact material strip and a part of the mounting portions of the respective said metal contacts into one respective cavity of said molding mold is to hold a plurality of said contact material strips at two said contact material strips at different elevations and then to move said contact material strips toward at least one said molding mold for enabling the contact portions of each three said metal contacts to be inserted in a triangular pattern into one said cavity of one said molding mold for making a 3-pin electrical power connector.

9. The electrical connector preparation method as claimed in claim 1, wherein when each set of said metal contacts with the respective said electrically insulative terminal block is assembled with one respective said electrically insulative housing during step (h), the mating contact portions of each set of said metal contacts are kept suspending in the front receiving chamber of the respective said electrically insulative housing, and the mounting portions of each set of said metal contacts are extended out of the respective said electrically insulative housing.

10. The electrical connector preparation method as claimed in claim 1, wherein one respective said electrically insulative terminal block that is molded on each set of said metal contacts during step (g) comprises a plurality of retaining protrusions and a plurality of locating grooves at a front wall of said electrically insulative terminal block, each said retaining protrusion defining a front sloping guide surface, and wherein the electrically insulative housing comprises a plurality of locating blocks in said rear insertion hole, said retaining protrusions of each said electrically insulative terminal block being respectively forced into engagement with respective retaining grooves of the respective said electrically insulative housing and said locating grooves of each said electrically insulative terminal block being respectively forced into engagement with respective locating blocks of each electrically insulative housing during step (h).

11. The electrical connector preparation method as claimed in claim 10, wherein each said retaining protrusion further defines a rear vertical stop surface at a rear side of front sloping guide surface; when inserting each set of said metal contacts with the respective said electrically insulative terminal block though the rear insertion hole of one respective said electrically insulative housing into the front receiving chamber of the respective said electrically insulative housing during step (h), the front sloping guide surfaces of said retaining protrusions of said electrically insulative terminal block guide the rear vertical stop surfaces of said retaining protrusions into engagement with the respective said retaining grooves in said rear insertion hole of the respective said electrically insulative housing.

12. The electrical connector preparation method as claimed in claim 1, wherein after removal of said at least one molding mold in step (h), said one contact material strip is moved toward a plurality of electrically insulative housing to insert each set of metal contacts with the respective said electrically insulative terminal block into one respective electrically insulative housing for making a 2-pin electrical power connector.

13. The electrical connector preparation method as claimed in claim 12, wherein after removal of said at least one molding mold in step (h), the contact material strip is cut to a predetermined length so that a predetermined number of set of metal contacts with the electrically insulative terminal blocks are carried at the contact material strip, and then said contact material strip of predetermined length is moved to insert each set of said metal contacts with the respective said electrically insulative terminal blocks into said respective said electrically insulative housing.

14. The electrical connector preparation method as claimed in claim 12, wherein each two said metal contacts are removed from said contact material strip and then installed with the associating said electrically insulative terminal block in one respective said electrically insulative housing to form one respective 2-pin electrical power connector.

15. The electrical connector preparation method as claimed in claim 12, further comprising a sub step of bending the mounting portion of each said metal contact into at least one curved portion after step (f) where each said metal contact is electroplated.

16. The electrical connector preparation method as claimed in claim 12, further comprising a sub step of bending the mounting portion of each said metal contact into at least one curved portion after step (h) where said at least one molding mold is removed from the respective said metal contacts.

* * * * *